US008888574B2

(12) United States Patent
Bredahl et al.

(10) Patent No.: US 8,888,574 B2
(45) Date of Patent: Nov. 18, 2014

(54) EXHAUST BOX

(75) Inventors: Thomas Bredahl, Miami Springs, FL (US); John Michael Leete, Ft. Lauderdale, FL (US)

(73) Assignee: FSH Industries, LLC, Miami Springs, FL (US)

( * ) Notice: Subject to any disclaimer, the term of this patent is extended or adjusted under 35 U.S.C. 154(b) by 1733 days.

(21) Appl. No.: 12/174,515

(22) Filed: Jul. 16, 2008

(65) Prior Publication Data

US 2009/0023379 A1 Jan. 22, 2009

Related U.S. Application Data

(60) Provisional application No. 60/949,998, filed on Jul. 16, 2007.

(51) Int. Cl.

| | |
|---|---|
| ***F24F 7/00*** | (2006.01) |
| ***F24F 13/08*** | (2006.01) |
| ***F24F 13/14*** | (2006.01) |

(52) U.S. Cl.

CPC ..... *F24F 13/082* (2013.01); *F24F 2007/002* (2013.01); *F24F 13/1413* (2013.01)

USPC ..... 454/339; 454/271

(58) Field of Classification Search

USPC ..... 454/268, 267, 335, 336, 333, 353, 259

See application file for complete search history.

(56) References Cited

U.S. PATENT DOCUMENTS

| | | | | |
|---|---|---|---|---|
| 2,912,920 | A * | 11/1959 | Coe | 454/342 |
| 4,094,336 | A * | 6/1978 | Urschel et al. | 137/512.1 |
| 4,967,490 | A * | 11/1990 | Berger et al. | 34/235 |
| 5,383,816 | A | 1/1995 | Marcello et al. | |
| 6,776,704 | B2 * | 8/2004 | Goncalves et al. | 454/8 |

FOREIGN PATENT DOCUMENTS

JP 05332611 A * 12/1993

* cited by examiner

*Primary Examiner* — Steven B McAllister
*Assistant Examiner* — Brittany Towns
(74) *Attorney, Agent, or Firm* — Procopio, Cory, Hargreaves & Savitch LLP

(57) ABSTRACT

An exhaust apparatus provides a housing with at least one exhaust compartment disposed within the housing, and at least one draft damper repositionable to operate at orientations of about 0°, 90°, 180° and 270° with respect to a level plane of an exterior bottom surface of the housing.

3 Claims, 13 Drawing Sheets

EXHAUST BOX

CROSS-REFERENCE TO RELATED APPLICATIONS

This application claims priority from U.S. Provisional Application No. 60/949,998, filed Jul. 16, 2007 in the U.S. Patent and Trademark Office, the disclosure of which is incorporated herein by reference.

BACKGROUND OF THE INVENTION

1. Field of the Invention

Apparatuses consistent with the present invention relate to exhaust systems for buildings, and more particularly to exhaust apparatuses for conducting exhaust gasses from one or more exhaust ducts through a wall of a building.

2. Description of the Related Art

Design and construction of multiple unit buildings, for example apartment buildings, condominiums and office buildings, as well as residential structures, require accommodations for external venting for appliances, for example clothes dryers, as well as exhaust fans for cook tops and bathrooms. One solution for external venting is to provide one or more common internal exhaust stacks extending up through the roof of the structure to which multiple vents are attached. However, this solution reduces the usable internal building space.

Another solution for external venting is to individually vent each exhaust fan and appliance in each of the multiple units. In this case, and an external exhaust fixture is required to conduct each exhaust duct through the exterior of the structure.

However, several problems exist with such a solution. Presently, each exhaust duct must be connected to its own exhaust fixture resulting in a large number of exhaust fixtures protruding through the exterior of the building. Further, exhaust ducts have different diameters depending on their application. Therefore, different exhaust fixtures necessary to accommodate the different sized ducts must be installed. Also, design and construction constraints can dictate different orientations of the exhaust fixture requiring additional exhaust fixtures which differ based on the orientation in which they must be installed.

Further, currently available exhaust fixtures protrude excessively from the exterior surface of the building increasing the possibility of moisture entry as well as back flow of exhaust and noise produced by internal exhaust fixture draft dampers fluctuating due to wind currents flowing along the exterior of the building surface.

SUMMARY OF THE INVENTION

Exemplary embodiments of the present invention overcome the disadvantages described above and other disadvantages not described above. Also, the present invention is not required to overcome the disadvantages described above, and an exemplary embodiment of the present invention may not overcome any of the problems described above.

The present invention provides an exhaust apparatus for conducting exhaust gasses from one or more exhaust ducts through a wall of a structure.

According to an aspect of the present invention there is provided an exhaust apparatus including a housing with at least one exhaust compartment disposed within the housing, at least one separator fin disposed within the housing, an exhaust port adapter attached to the housing, and at least one movable draft damper disposed between the housing and the exhaust port adapter to allow gas flow in a direction from the exhaust port adapter to the at least one exhaust compartment and to substantially prevents gas flow in a direction from the at least one exhaust compartment to the exhaust port adapter.

According to another aspect of the present invention there is provided a multi-port exhaust box having a housing comprising a plurality of exhaust compartments disposed therein, a plurality of separator fins disposed within the housing and providing a separation between adjacent ones of the plurality of exhaust compartments, an exhaust port adapter having a plurality of exhaust ports and a plurality of draft damper openings each corresponding to one of the plurality of exhaust ports connected to the housing; and a plurality of movable draft dampers disposed between the housing and the exhaust port adapter, wherein the draft dampers are operable in orientations of zero degrees, ninety degrees, one hundred eighty degrees and two hundred seventy degrees corresponding to an orientation of the housing.

According to yet another aspect of the present invention there is provided an exhaust apparatus including a housing comprising at least one exhaust compartment, an exhaust port adapter attached to the housing in fluid communication with the at least one exhaust compartment, and at least one draft damper assembly disposed between the housing and the exhaust port adapter, wherein the draft damper assembly includes a frame forming at least one draft damper window, and at least one hinged draft damper disposed within the at least one draft damper window.

According to yet another aspect of the present invention there is provided an exhaust box including a housing having a plurality of exhaust compartments, a separator fin disposed between adjacent ones of the plurality of exhaust compartments, an exhaust port adapter comprising a plurality of exhaust ports attached to the housing in fluid communication with the plurality of exhaust compartments, and a plurality of draft damper assemblies each corresponding to one of the plurality of exhaust ports.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 1:
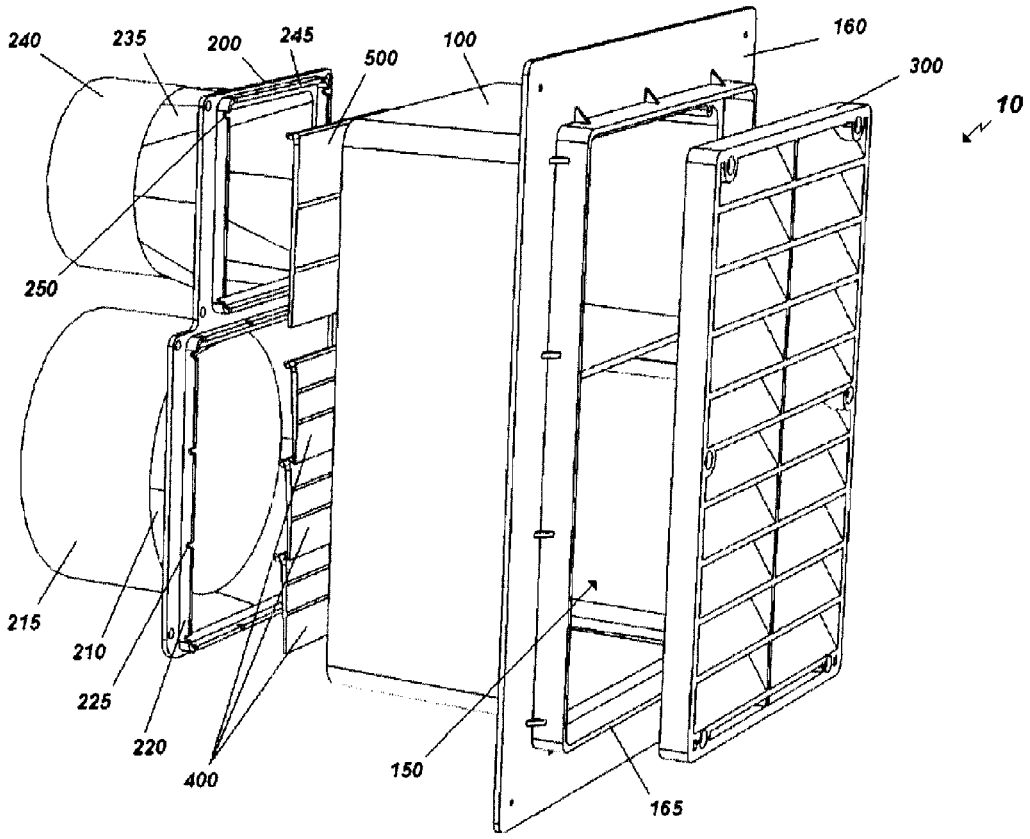
FIG. 1 is a front perspective view of an exhaust apparatus according to a first non-limiting exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below so as to explain the present invention by referring to the figures.

Exemplary embodiments of the exhaust apparatus provide at least one exhaust port and may provide a plurality of exhaust ports which may be of different diameters thereby accommodating multiple exhaust duct connections to one exhaust box. Exemplary embodiments of the exhaust apparatus may be constructed from non-corrosive and/or high-impact materials.

Figure 2:
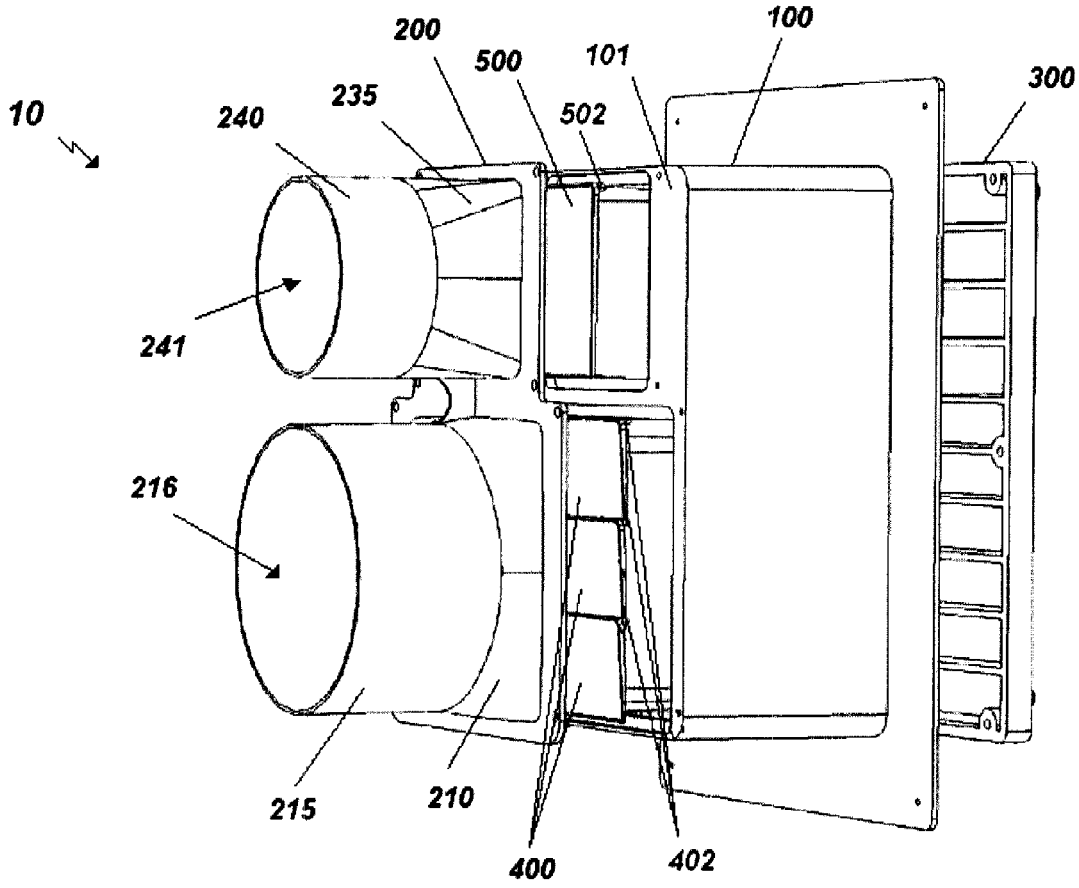
FIG. 2 is a rear perspective view of the exhaust apparatus according to the first non-limiting exemplary embodiment of the present invention.

FIG. 1 is a front perspective view of an exhaust apparatus 10 according to a first non-limiting exemplary embodiment of the present invention, and FIG. 2 is a rear perspective view of the exhaust apparatus 10 according to the first non-limiting exemplary embodiment of the present invention. Referring to FIGS. 1 and 2, the exhaust apparatus 10 includes a housing 100 having a front opening 150 which is covered by an exterior louver 300. A mounting flange 160 for mounting the exhaust apparatus 10 to a structure extends around exterior surfaces of the housing 100 in a direction substantially parallel to the front opening 150 of the housing 100. The exterior louver 300 fits within a louver mounting flange 165 which is circumferentially disposed around the front opening 150.

Hinged first and second draft dampers 400, 500 are positioned between a rear exterior surface 101 of the housing 100 and an exhaust port adapter 200 attached to the rear exterior surface 101 of the housing 100. The first and second draft dampers 400, 500 are mounted on first and second draft damper mounting flanges 220, 245. The first and second draft dampers 400, 500 are maintained in a closed position by gravity in the absence of a gas flow which causes the first and second draft dampers 400, 500 to pivotably open.

The first and second draft damper mounting flanges 220, 245 are circumferentially disposed around first and second draft damper openings 205, 230 and include first and second draft damper mounting grooves 225, 250 spaced around the first and second draft damper mounting flanges 220, 245 to accommodate various mounting positions of the first and second draft dampers 400, 500. The first draft damper 400 has axial protrusions 402 which allow the first draft damper 400 to pivot in the first draft damper mounting grooves 225. Likewise, the second draft damper 500 has axial protrusions 502 which allow the second draft damper 500 to pivot in the second draft damper mounting grooves 250.

One of ordinary skill in the art will understand that while the exemplary embodiment illustrates the first draft damper 400 having three draft damper sections for mounting in the first draft damper mounting flange 220 and the second draft damper 500 having one draft damper section for mounting in the second draft damper mounting flange 245, the number and size of the draft damper sections can vary.

The exhaust port adapter 200 attaches to the rear exterior surface 101 of the housing 100 thereby retaining the first and second draft dampers 400, 500. The exhaust port adapter 200 may have one or more exhaust ports to which exhaust ducts are typically attached.

Figure 3:
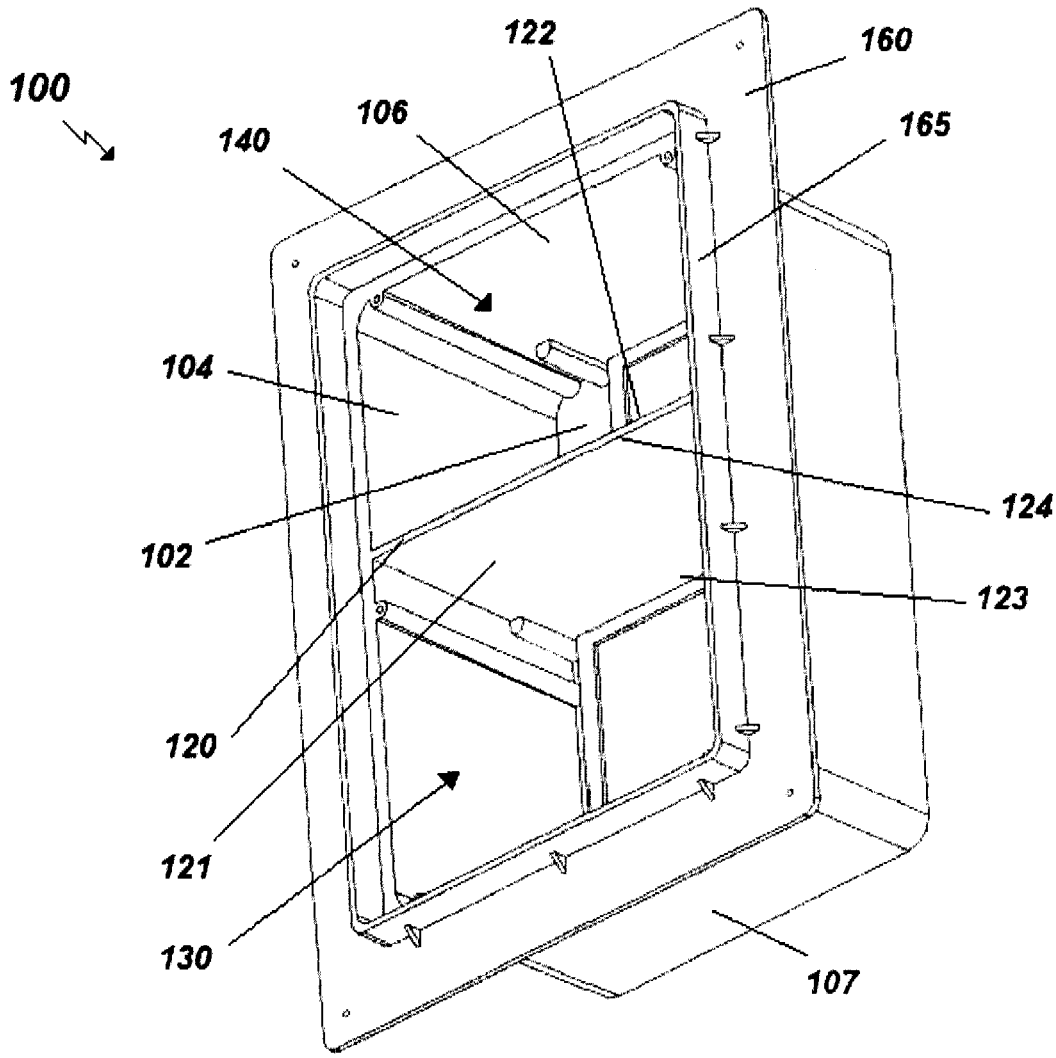
FIG. 3 is a front perspective view of a housing according to the first non-limiting exemplary embodiment of the present invention.
Figure 4:
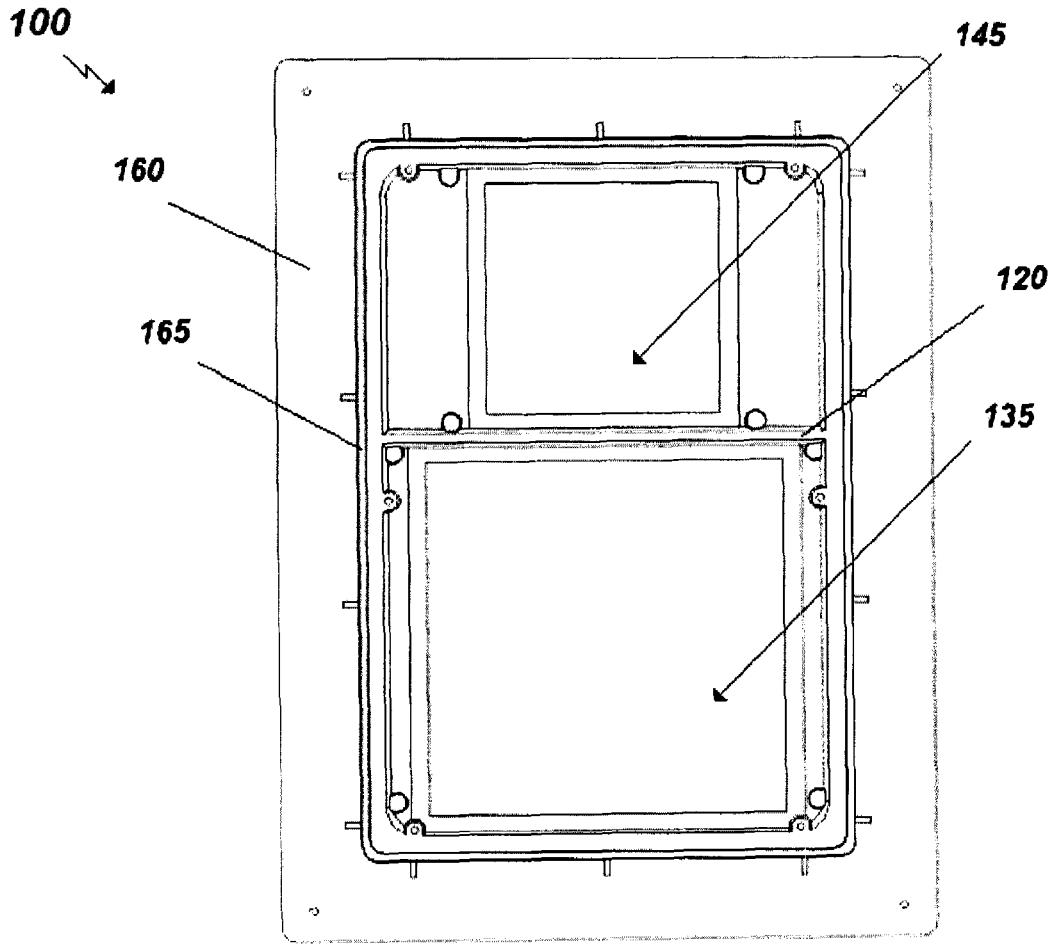
FIG. 4 is a front view of the housing according to the first non-limiting exemplary embodiment of the present invention.

FIG. 3 is a front perspective view of the housing 100 according to the first non-limiting exemplary embodiment of the present invention and FIG. 4 is a front view of the housing 100 according to the first non-limiting exemplary embodiment of the present invention. The housing 100 has a substantially rectangular shape, but is not limited to that shape. The housing 100 has at least one exhaust compartment, but may have a plurality of exhaust compartments. In the first non-limiting exemplary embodiment, the housing 100 has a first exhaust compartment 130 and a second exhaust compartment 140. First and second exhaust openings 135, 145 are provided for entry of the exhaust gas into the first and second exhaust compartments 130, 140.

The first and second draft dampers 400, 500 are positioned behind the first and second exhaust openings 135, 145. The first and second draft dampers 400, 500 pivot open to allow exhaust gas to flow from first and second exhaust port openings 216, 241 through the first and second exhaust openings 135, 145 into the first and second exhaust compartments 130, 140 and pivot closed to prevent exhaust backflow, wind and/or moisture flowing from the exhaust compartments 130, 140 in the opposite direction through the first and second exhaust openings 135, 145.

In the first non-limiting exemplary embodiment, the first and second exhaust compartments 130, 140 are separated by a separator fin 120. The separator fin 120 in the first non-limiting exemplary embodiment of the exhaust apparatus prevents cross flow of exhaust gas between the first and second exhaust compartments 130, 140. One of ordinary skill in the art will understand that while the exemplary embodiment illustrates two exhaust compartments separated by a separator fin, the number of exhaust compartments may vary and separator fins may be provided as a separation between adjacent exhaust compartments.

The separator fin 120 is attached to the rear internal surface 102 of the housing 100 and extends to the front opening 150. The separator fin 120 also extends between the internal side surfaces 104 of the housing 100 thereby forming a partition to create the exhaust compartments 130, 140. The separator fin 120 is formed such that the distance between a first surface 121 and a second surface 122 of the separator fin 120 is greater at an interior edge 123 than at an exterior edge 124. Accordingly, the separator fin 120 may have a wedge shape causing accumulated moisture to run off of the separator fin 120 in a direction from the interior edge 123 towards the exterior edge 124 thereby preventing moisture accumulation on the first or second surface 121, 122 of the separator fin 120.

The internal side surfaces 104 and internal end surfaces 106 of the housing 100 are pitched in a direction from the internal rear surface 102 towards the front opening 150 tending to cause moisture to run off of the internal side surfaces 104 and internal end surfaces 106 in a direction from the internal rear surface 102 towards the front opening 150, thereby preventing moisture accumulation on the internal side surfaces 104 and internal end surfaces 106 of the housing 100.

Exemplary embodiments of the exhaust apparatus can be installed flush with the exterior surface of the structure minimizing the wind related deficiencies and resulting in a more aesthetically pleasing appearance. The mounting flange 160 secures the exhaust apparatus 10 to a structure wall prior to application of an exterior finishing surface of the structure. When installed in a building exterior wall, single cavity construction prevents water intrusion from the exterior of the building. The finishing surface of the structure, for example, but not limited to, stucco or concrete, may then be applied to a thickness substantially equal to the height of the louver mounting flange 165. Accordingly, the exterior louver 300 is the only portion of the exhaust apparatus 10 visible on the building exterior.

Figure 7:
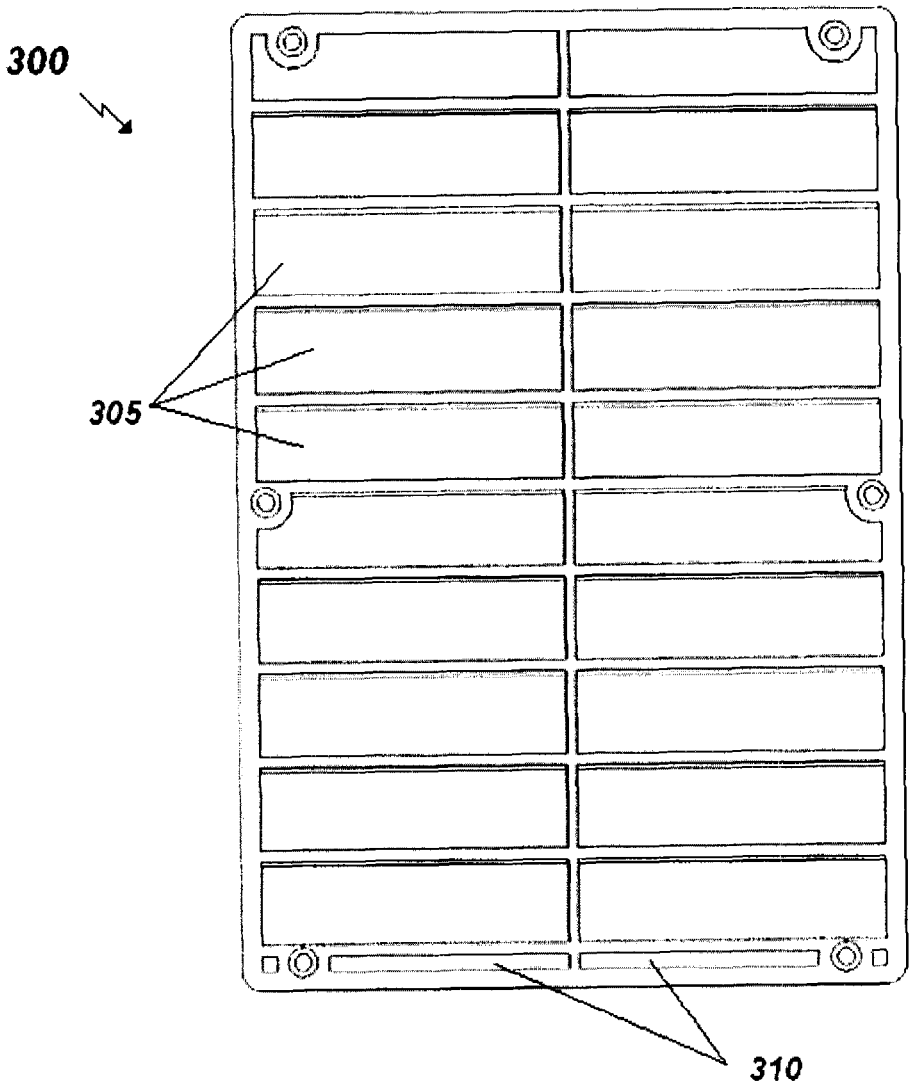
FIG. 7 is a front view of an exterior louver according to the first non-limiting exemplary embodiment of the present invention.

FIG. 7 is a front view of an exterior louver 300 according to the first non-limiting exemplary embodiment of the present invention. As illustrated in FIG. 7, the louver 300 may be constructed with fins 305 configured to minimize entry of external elements, for example, but not limited to, wind, rain, birds, etc., to the exhaust compartments of the exhaust apparatus 10 while allowing exhaust gases to flow from the exhaust compartments to the ambient environment.

The exterior louver 300 is removably attached within the louver mounting flange 165 to the housing 100 using removable fasteners, for example, but not limited to screws and clips. This removable exterior louver configuration advantageously provides for removal of the exterior louver 300 to perform maintenance of the exhaust apparatus 10 without compromising the sealing integrity between the exhaust apparatus 10 and the structure.

The exterior louver 300 may also include drainage holes 310 to provide for drainage of moisture which enters the exhaust compartments. Also, the exterior louver 300 may be color matched to the exterior of the building and is removable to permit periodic maintenance.

While one non-limiting exemplary embodiment of the exterior louver is illustrated in FIG. 7, one of ordinary skill in the art will also understand that other exterior louver configurations which minimize entry of external elements and allow exhaust gas flow to the ambient environment are possible.

The exhaust apparatus 10 incorporates features which allow for installation in any one of four orientations to accommodate design and construction requirements and exhaust duct placement. The exhaust draft dampers may be positioned for proper operation when the exhaust apparatus 10 is installed in a structure wall at orientations of approximately 0°, 90°, 180° and 270° with respect to a level plane of an exterior bottom surface 107 of the housing 100.

Figure 5:
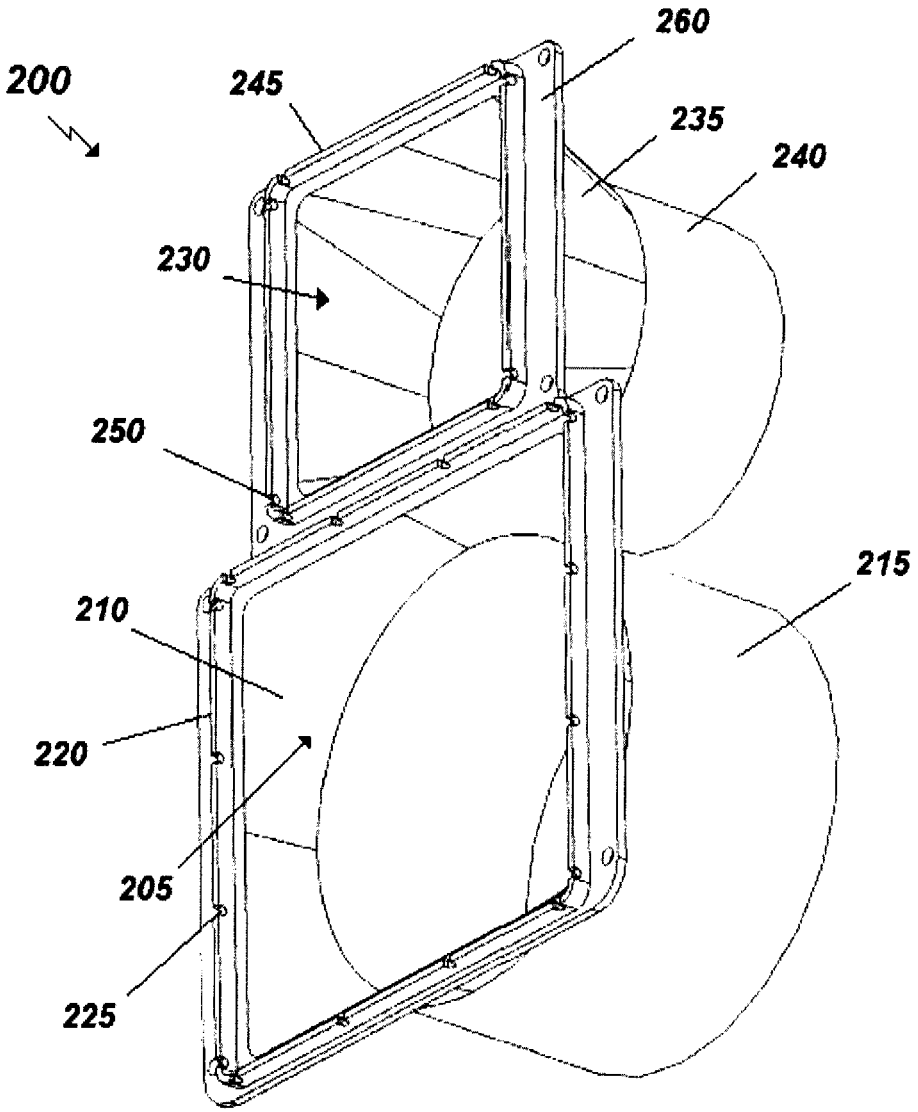
FIG. 5 is a front perspective view of an exhaust port adapter according to the first non-limiting exemplary embodiment of the present invention.
Figure 6:
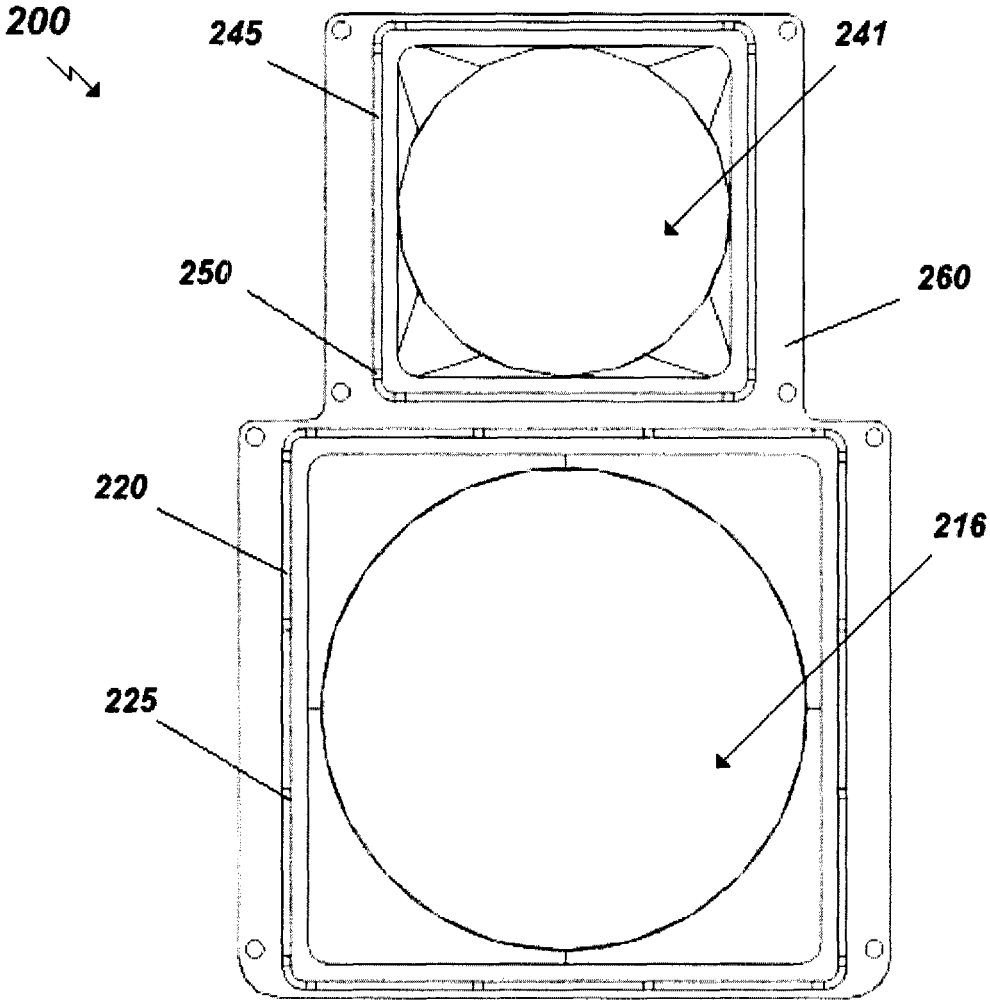
FIG. 6 is a front view of the exhaust port adapter according to the first non-limiting exemplary embodiment of the present invention.

FIG. 5 is a front perspective view of an exhaust port adapter 200 according to the first non-limiting exemplary embodiment of the present invention and FIG. 6 is a front view of the exhaust port adapter 200 according to the first non-limiting exemplary embodiment of the present invention. Referring to FIGS. 5 and 6, the first and second draft damper mounting flanges 220, 245 each have a plurality of draft damper mounting grooves 225, 250 to pivotably retain the first and second draft dampers 400, 500. The draft damper mounting grooves 225, 250 are spaced around the first and second draft damper mounting flanges 220, 245 such that the first and second draft dampers 400, 500 may be repositioned to provide proper draft damper operation in any of the four installation orientations of the exhaust apparatus 10.

Accordingly, by removing the exhaust port adapter 200, the draft dampers 400, 500 may be repositioned for the required installation orientation of approximately 0°, 90°, 180° and 270° thereby eliminating the need to fabricate and purchase different exhaust apparatuses for installation at different orientations. Further, referring to FIGS. 3 and 4, the internal side surfaces 104 and internal end surfaces 106 of the housing are pitched to encourage drainage of moisture in any of the four installation orientations.

Referring again to FIGS. 5 and 6, the exhaust port adapter 200 has at least one exhaust port in fluid communication with an exhaust opening but may have a plurality of exhaust ports in fluid communication with a plurality of exhaust openings. In the first non-limiting exemplary embodiment, the exhaust port adapter 200 has a first exhaust port 215 in fluid communication with a first draft damper opening 205 and a second exhaust port 240 in fluid communication with a second draft damper opening 230.

The first and second exhaust ports 215, 240 may have differently sized exhaust port openings 216, 241, and the first and second draft damper openings 205, 230 may also have different sizes. First and second collars 210, 235 adapt the first and second exhaust port openings 216, 241 to appropriate sizes and shapes of the first and second draft damper openings 205, 230.

In other exemplary embodiments of the present invention, the draft dampers arranged in the draft damper retaining grooves may be replaced by a draft damper assembly.

Figure 8:
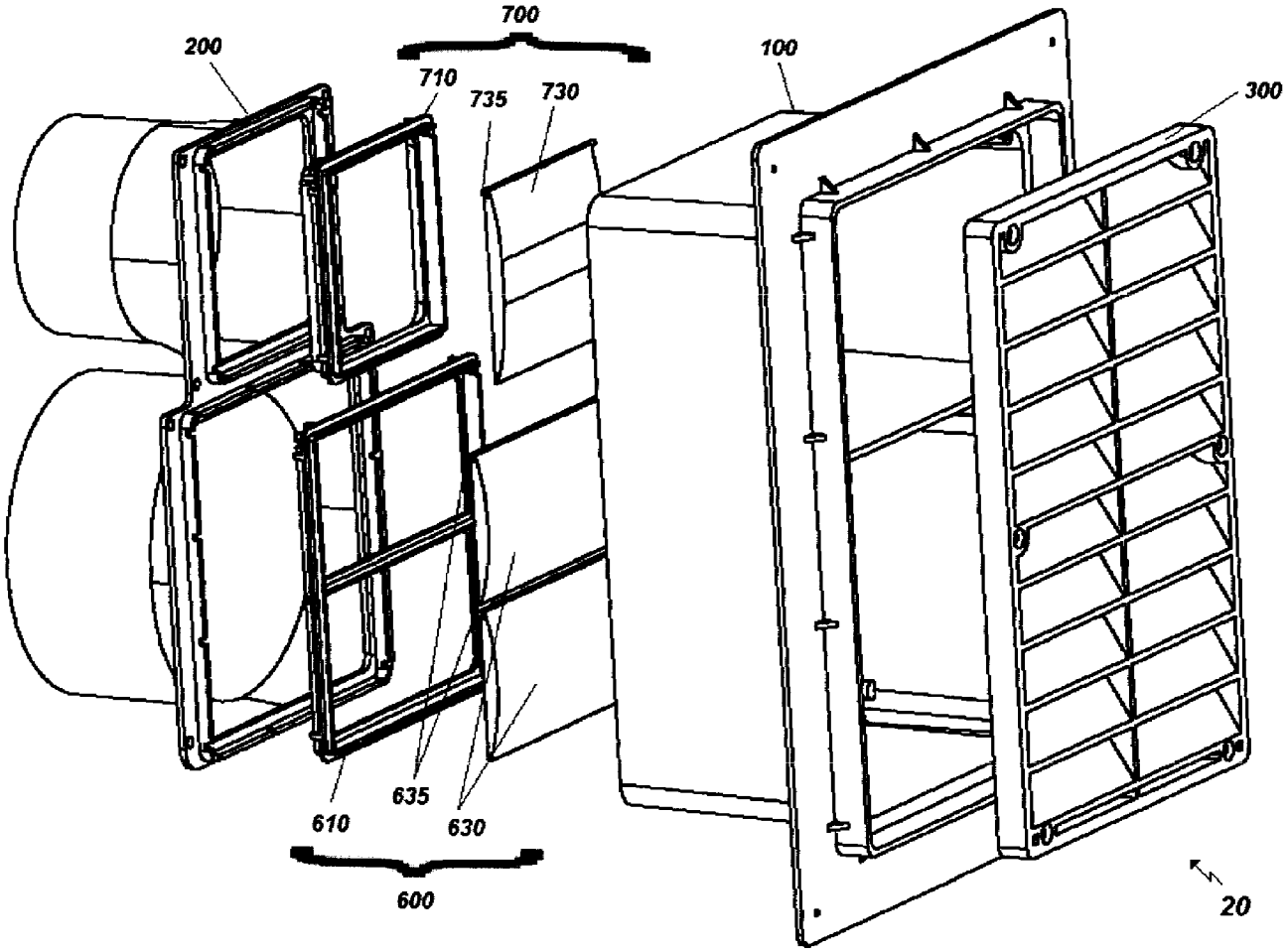
FIG. 8 is a front perspective view of an exhaust apparatus according to a second non-limiting exemplary embodiment of the present invention.

FIG. 8 is a front perspective view of an exhaust apparatus according to a second non-limiting exemplary embodiment of the present invention. In the second non-limiting exemplary embodiment of the exhaust apparatus 20, the housing 100, exhaust port adapter 200 and exterior louver 300 incorporate the features of the first non-limiting exemplary embodiment of the exhaust apparatus 10. Descriptions of these features will therefore not be repeated for the second non-limiting exemplary embodiment of the exhaust apparatus 20.

In the second non-limiting exemplary embodiment of the exhaust apparatus 20, first and second draft damper assemblies 600, 700 are disposed within the first and second draft damper mounting flanges 220, 245 of the exhaust port adapter 200, and are positioned behind the first and second exhaust openings 135, 145 of the housing 100. Attachment of the exhaust port adapter 200 to the rear exterior surface 101 of the housing 100 retains the first and second draft damper assemblies 600, 700.

Figure 9A:
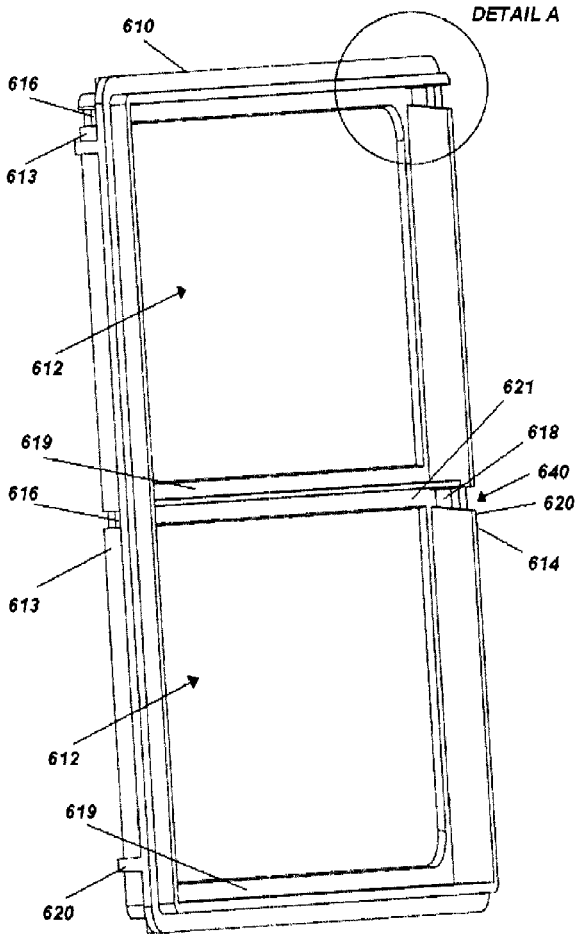
FIG. 9A is a perspective view of a draft damper frame according to the second non-limiting exemplary embodiment of the present invention.
Figure 9B:
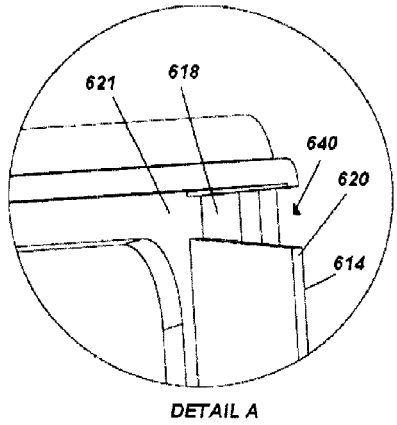
FIG. 9B is a detail view of a portion of the draft damper frame according to the second non-limiting exemplary embodiment of the present invention.
Figure 10A:
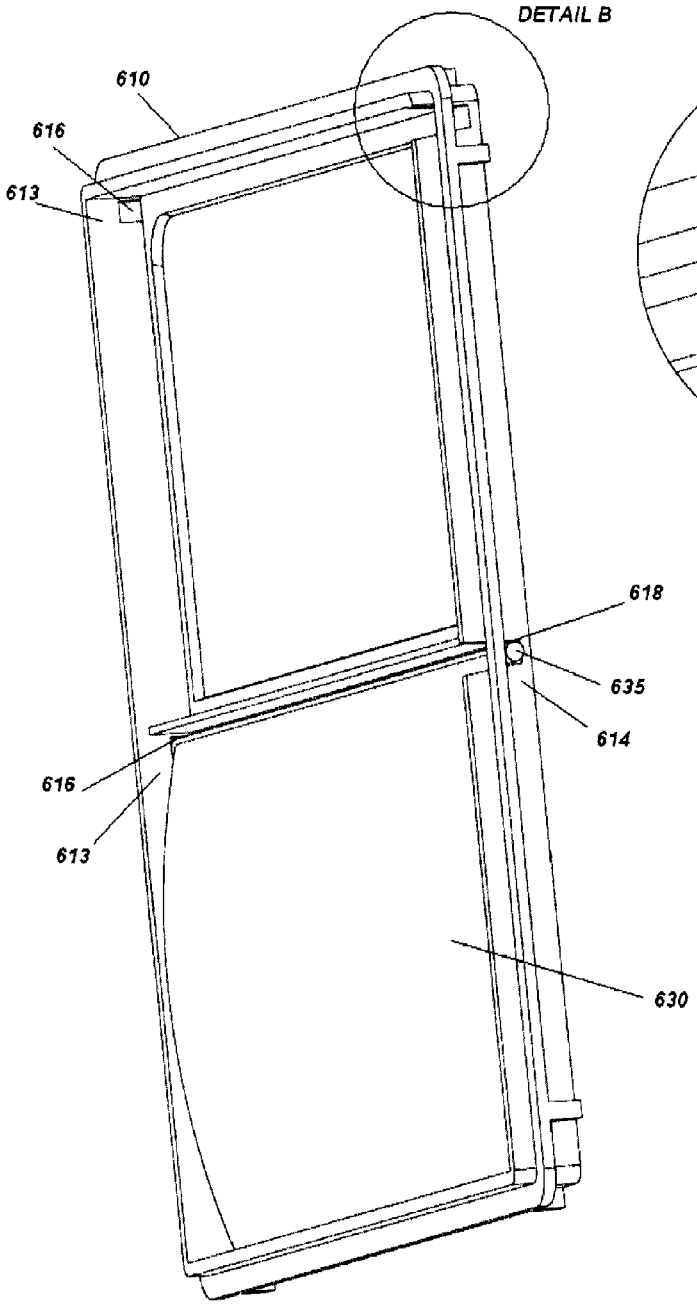
FIG. 10A is another perspective view of the draft damper frame according to the second non-limiting exemplary embodiment of the present invention.
Figure 10B:
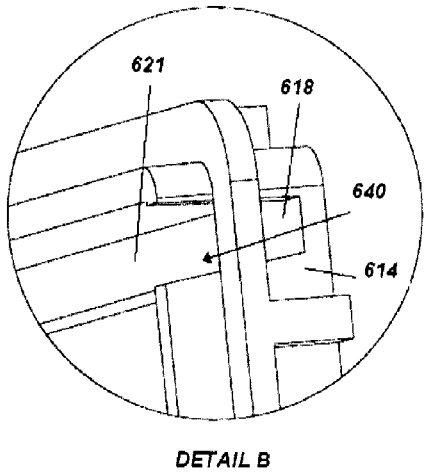
FIG. 10B is another detail view of a portion of the draft damper frame according to the second non-limiting exemplary embodiment of the present invention.

The first draft damper assembly 600 includes a first draft damper frame 610 and third draft dampers 630. FIGS. 9A and 10A are perspective views of a draft damper frame according to the second non-limiting exemplary embodiment of the present invention and FIGS. 9B and 10B are detail views of a portion of the draft damper frame according to the second non-limiting exemplary embodiment of the present invention.

The first draft damper frame 610 may include a plurality of first tabs 620 spaced around a perimeter of the first draft damper frame 610 which coincide with the first draft damper mounting grooves 225 in the first draft damper mounting flange 220. The draft damper frame 610 may include a plurality of draft damper windows 612. The draft damper windows 612 advantageously provide sealing surfaces 619 for improved sealing when the third draft dampers 630 are in a closed position. The sealing surfaces 619 may extend around the entire internal periphery of the draft damper windows 612. Each of the third draft dampers 630 is disposed within one of draft damper windows 612.

Figure 11A:
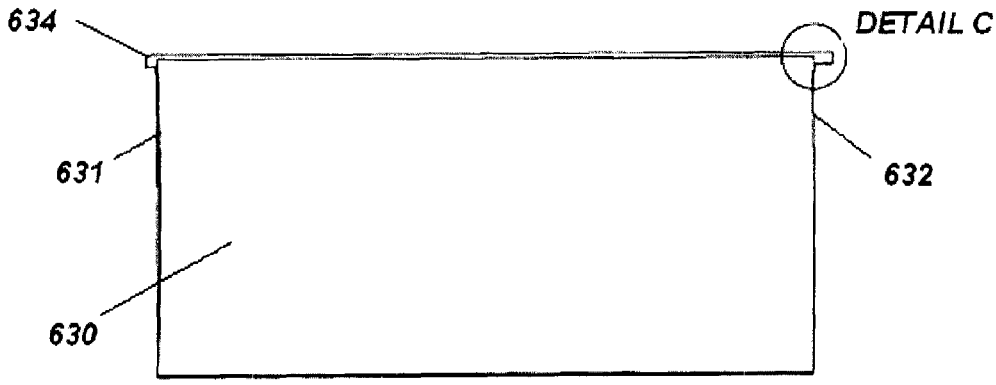
FIG. 11A is a plan view of a draft damper according to the second non-limiting exemplary embodiment of the present invention.
Figure 11B:
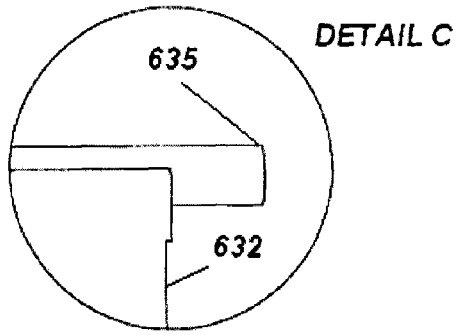
FIG. 11B is a detail view of a portion of the draft damper frame according to the second non-limiting exemplary embodiment of the present invention.

FIG. 11 is a plan view of a draft damper according to the second non-limiting exemplary embodiment of the present invention and FIG. 11A is a detail view of a portion of the draft damper frame according to the second non-limiting exemplary embodiment of the present invention. The third draft damper 630 includes first and second axial protrusions 634, 635. The second axial protrusions 635 may protrude further from the second edge 632 of the third draft damper 630 than the first axial protrusions 634 protrudes from the first edge 631 of the third draft damper 630.

Referring again to FIGS. 9A, 9B, 10A and 10B, each draft damper window 612 includes first and second retaining holes 616, 618 disposed in the first draft damper frame 610 at each upper side portion 613, 614 of each draft damper window 612 and adjacent to a rear inner surface 621 of each draft damper window 612. The first and second axial protrusions 634, 635 (see FIG. 11) engage the first and second retaining holes 616, 618 to pivotably retain the third draft dampers 630 within the draft damper windows 612. A damper removal slot 640 is disposed at one upper side portion of each draft damper window 612.

In the second non-limiting exemplary embodiment, two draft damper windows 612 are provided in the first draft damper frame 610, and a damper removal slot 640 is provided at the upper side portion 614 of each draft damper window 612. The draft damper removal slot 640 is co-located with the second retaining hole 618 and extends along a width of an inside surface of an upper side portion 614 of the first draft damper frame 610 from an outer surface 620 of the upper side portion 614 to the rear inner surface 621 of each draft damper window 612 forming a slot in the upper side portion 614.

The draft damper removal slot 640 is sized to accommodate a thickness of the third draft damper 630. The draft damper removal slot 640 allows removal of the third draft damper 630 from the draft damper windows 612 when the third draft damper 630 is lifted to a position approximately perpendicular to the draft damper window 612 thereby aligning the second edge 632 of the third draft damper 630 with the draft damper removal slot 640. Since the damper removal slot 640 is sized to accommodate the thickness of the third draft damper 630 at the second edge 632 of the third draft damper 630, the third draft damper 630 may be urged into the draft damper removal slot 640 thereby releasing the axial protrusion 634 of the third draft damper 630 from the retaining hole 616 allowing removal of the third draft damper 630 from the draft damper window 612. The ability to remove the draft dampers provided by the exemplary embodiments of the present invention advantageously allows access to the exhaust port adapter and any duct work connected thereto to easily perform inspection and maintenance.

One of ordinary skill in the art will understand that a damper removal slot may alternatively be provided in the opposite upper side portion or in both upper side portions of each draft damper window.

In the second non-limiting exemplary embodiment, two draft damper windows are provided in the first draft damper frame. However, one of ordinary skill in the art will recognize that the draft damper frame is not limited to two draft damper windows and may provide more or less than that number, each draft damper window similarly constructed to accommodate a removable draft damper as explained above.

The second draft damper assembly 700 includes a second damper frame 710 and a fourth draft damper 730. The second draft damper frame 710 may include a plurality of second tabs 720 spaced around a perimeter of the second draft damper frame 710 which coincide with the second draft damper mounting grooves 250 in the second draft damper mounting flange 245. In the second non-limiting exemplary embodiment, the second draft damper frame 710 provides one draft damper window 712 which is similarly constructed to one of the draft damper windows 612 in the first draft damper frame 610. In like manner to the first draft damper frame 610, the second draft damper frame 710 includes sealing surfaces which may extend around the entire internal periphery of the draft damper window first and second draft damper retaining holes to pivotably retain the fourth draft damper 730, and a damper removal slot. The fourth draft damper 730 is similarly constructed to the third draft damper 630 and is removable from the second draft damper frame 710 in a similar manner to removal of the third draft damper 630 from the first draft damper frame 610.

The first and second draft damper assemblies 600, 700 may be positioned within the first and second draft damper mounting flanges 220, 245 for proper operation when the exhaust apparatus 20 is installed in a structure wall at orientations of approximately 0°, 90°, 180° and 270° with respect to a level plane of an exterior bottom surface 107 of the housing 100. One of ordinary skill in the art will understand that the first and second tabs 620, 720 on the first and second damper frames 610, 710 may be omitted.

Figure 12:
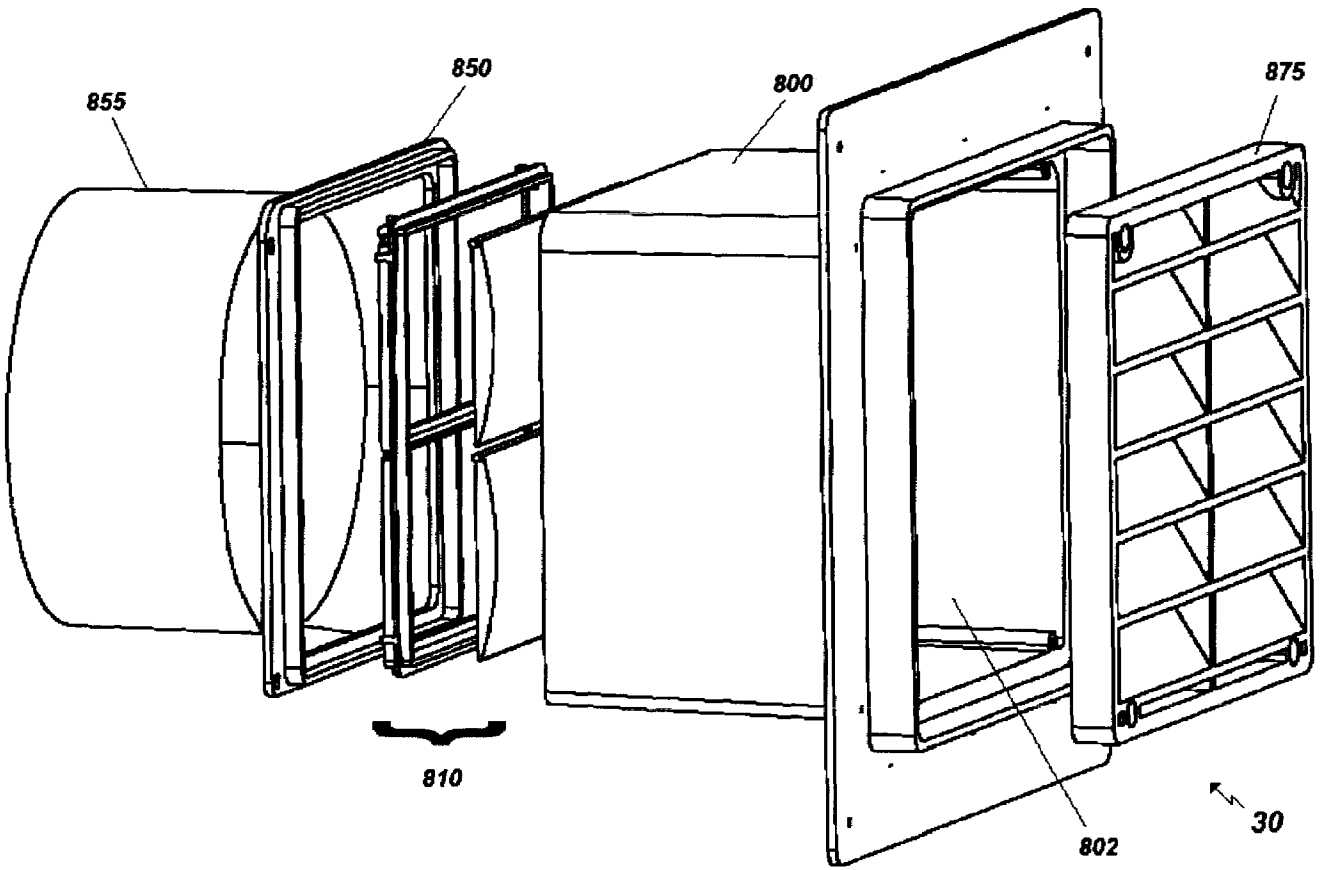
FIG. 12 is a front perspective view of an exhaust apparatus according to a third non-limiting exemplary embodiment of the present invention.

FIG. 12 is a front perspective view of an exhaust apparatus according to a third non-limiting exemplary embodiment of the present invention. In the third non-limiting exemplary embodiment of the present invention, an exhaust apparatus 30 includes a housing 800, a draft damper assembly 810, an exhaust port adapter 850 and exterior louver 875.

The third non-limiting exemplary embodiment of the exhaust apparatus incorporates the features of the second non-limiting exemplary embodiment, descriptions of which will therefore not be repeated for the third non-limiting exemplary embodiment. The third non-limiting exemplary embodiment differs from the second non-limiting exemplary embodiment in that the housing 800 provides one exhaust compartment 802 and the exhaust port adapter 850 provides one exhaust port 855. The exhaust port 855 may have a diameter of about 6 inches, but is not limited to that diameter. The draft damper assembly 810 of the third non-limiting exemplary embodiment may be constructed similarly to the draft damper assembly 610 of the second non-limiting embodiment.

Figure 13:
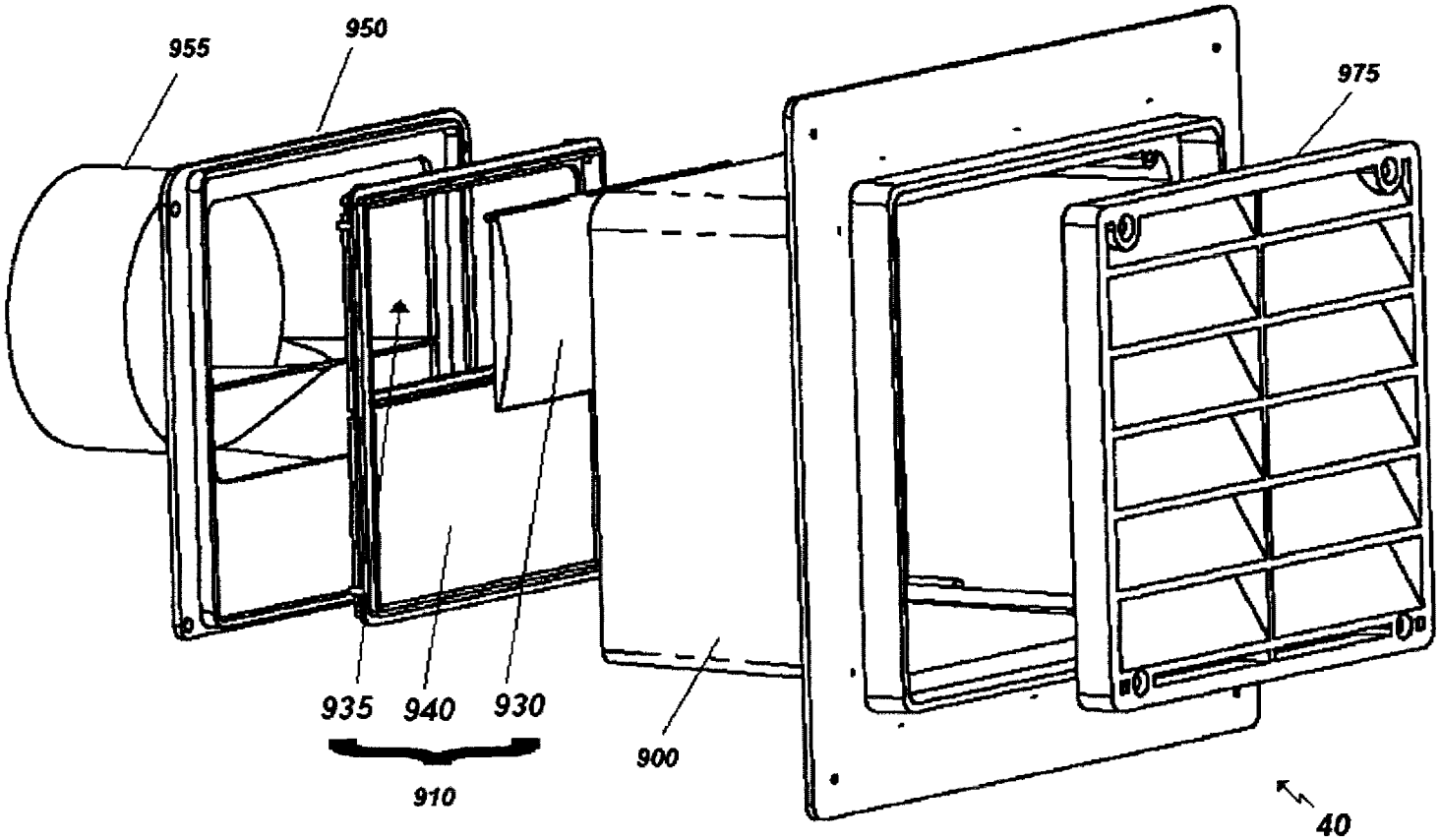
FIG. 13 is a front perspective view of an exhaust apparatus according to a fourth non-limiting exemplary embodiment of the present invention.

FIG. 13 is a front perspective view of an exhaust apparatus according to a fourth non-limiting exemplary embodiment of the present invention. In the fourth non-limiting exemplary embodiment of the present invention, an exhaust apparatus 40 includes a housing 900, a draft damper assembly 910, an exhaust port adapter 950 and exterior louver 975.

The fourth non-limiting exemplary embodiment of the exhaust apparatus incorporates the features of the third non-limiting exemplary embodiment, descriptions of which will therefore not be repeated for the fourth non-limiting exemplary embodiment. The fourth non-limiting exemplary embodiment differs from the third non-limiting exemplary embodiment in that the exhaust port adapter 950 provides one exhaust port 955 which may have a diameter of about 4 inches, but is not limited to that diameter. Further, the draft damper assembly 910 includes one draft damper 930 disposed within a draft damper window 935 and an upper portion of a draft damper frame 920. The draft damper window 935 is similarly constructed to the draft damper windows of the second and third non-limiting embodiments. A lower portion of the draft damper frame 920 contains a solid panel 940 rather than a draft damper.

The exhaust port adapter 950 may have a reducing portion 952 which adapts the exhaust port 955 to the size and shape of the draft damper window 935.

An exhaust apparatus for conducting exhaust gasses from one or more exhaust ducts through a wall of a structure has been provided. While the invention has been particularly shown and described with reference to a few exemplary embodiments, it will be understood and appreciated by those skilled in the art that various changes in form and details may be made therein without departing from the principles and spirit of the invention, the scope of which is defined in the appended claims and their equivalents.

What is claimed is:

1. An exhaust box comprising:

a housing comprising a plurality of exhaust compartments;

a separator fin disposed between adjacent ones of said plurality of exhaust compartments;

an exhaust port adapter comprising a plurality of exhaust ports attached to said housing in fluid communication with said plurality of exhaust compartments; and a plurality of draft damper assemblies each corresponding to one of said plurality of exhaust ports, wherein each of said plurality of draft damper assemblies comprises a frame forming at least one draft damper window, wherein at least one hinged draft damper is disposed within said at least one draft damper window, wherein said frame comprises a plurality of tabs spaced around a perimeter of said frame and corresponding to a plurality of mounting grooves disposed on said exhaust port adapter, wherein said at least one draft damper window comprises first and second retaining holes axially disposed from each other in said frame at upper side portions of said at least one draft damper window and adjacent to a rear inner surface of said at least one draft damper window, wherein said first and second retaining holes retain said at least one hinged draft damper, wherein said at least one draft damper window further comprises a slot disposed in an inside surface of an upper side portion of said draft damper window and co-located with one of said first and second retaining holes, wherein said slot extends along a width of said inside surface of said upper side portion of said frame from an outer surface of said upper side portion to said rear inner surface of said at least one draft damper window, and wherein said slot is sized to accommodate at least a thickness of said at least one draft damper.

2. The exhaust box according to claim 1, wherein said plurality of draft damper assemblies can be positioned for proper operation at orientations of approximately 0°, 90°, 180° and 270° with respect to a level plane of an exterior bottom surface of said housing.

3. The exhaust box according to claim 1, further comprising an exterior louver disposed over a front opening of said housing and removably fastened to said housing within a louver mounting flange.

* * * * *